US010371075B2

(12) United States Patent
Matohara et al.

(10) Patent No.: US 10,371,075 B2
(45) Date of Patent: Aug. 6, 2019

(54) CONTROL APPARATUS FOR INTERNAL COMBUSTION ENGINE

(71) Applicant: Hitachi Automotive Systems, Ltd., Hitachinaka-shi, Ibaraki (JP)

(72) Inventors: Shinya Matohara, Hitachinaka (JP); Yoshihiko Akagi, Hitachinaka (JP); Seiji Asano, Hitachinaka (JP); Kazuhiro Oryoji, Tokyo (JP)

(73) Assignee: Hitachi Automotive Systems, Ltd., Hitachinaka-shi (JP)

( * ) Notice: Subject to any disclaimer, the term of this patent is extended or adjusted under 35 U.S.C. 154(b) by 0 days.

(21) Appl. No.: 15/741,604

(22) PCT Filed: Jul. 6, 2016

(86) PCT No.: PCT/JP2016/069960

§ 371 (c)(1),
(2) Date: Jan. 3, 2018

(87) PCT Pub. No.: WO2017/010361

PCT Pub. Date: Jan. 19, 2017

(65) Prior Publication Data

US 2018/0195451 A1 Jul. 12, 2018

(30) Foreign Application Priority Data

Jul. 15, 2015 (JP) ..... 2015-140952

(51) Int. Cl.
*F02D 41/14* (2006.01)
*F02D 41/04* (2006.01)
(Continued)

(52) U.S. Cl.
CPC ..... *F02D 41/144* (2013.01); *F02D 41/0002* (2013.01); *F02D 41/0042* (2013.01);
(Continued)

(58) Field of Classification Search
CPC ..... F02D 2200/0418; F02D 41/0077; F02D 41/0072; F02D 41/0045; F02D 41/0042; F02D 41/0052; F02M 25/08; F02M 26/46
(Continued)

(56) References Cited

U.S. PATENT DOCUMENTS 5,619,973 A * 4/1997 Hara ..... F02D 41/0032 123/520
6,725,848 B2 * 4/2004 Ramamurthy ..... F02D 41/005 123/568.22
(Continued)

FOREIGN PATENT DOCUMENTS

JP 10-141114 A 5/1998
JP 2001-280202 A 10/2001
(Continued)

OTHER PUBLICATIONS

International Search Report (PCT/ISA/210) issued in PCT Application No. PCT/JP2016/069960 dated Sep. 20, 2016 with English translation (2 pages).
(Continued)

*Primary Examiner* — Mahmoud Gimie
(74) *Attorney, Agent, or Firm* — Crowell & Moring LLP

(57) ABSTRACT

An EGR rate estimation method using an EGR valve opening area involves aggravated EGR rate estimation accuracy as an EGR valve is deteriorated and is unable to satisfy required accuracy when a target EGR rate is high. With a method for correcting a fuel injection amount by a fuel injection valve through estimation of a purge air-fuel ratio on the basis of variations in an air-fuel ratio variable depending on whether purging is performed, the fuel injection correction fails to accommodate the change in the air-fuel ratio when concentration of fuel evaporative emissions adsorbed by an activated carbon of a canister is high, resulting in reduced conversion efficiency of a catalyst. An
(Continued)

arrangement includes an introduction port that is disposed in an intake pipe and through which a gas other than fresh air flows in the intake pipe and humidity sensors disposed upstream and downstream, respectively, of the introduction port. The EGR rate or the purge air-fuel ratio in the intake pipe is estimated using detection values of the respective humidity sensors.

13 Claims, 13 Drawing Sheets

(51) Int. Cl.

| | |
|---|---|
| ***F02D 43/00*** | (2006.01) |
| ***F02D 45/00*** | (2006.01) |
| ***F02P 5/15*** | (2006.01) |
| ***F02M 25/08*** | (2006.01) |
| ***F02M 26/46*** | (2016.01) |
| ***F02D 41/00*** | (2006.01) |

(52) U.S. Cl.
CPC ..... *F02D 41/0045* (2013.01); *F02D 41/0072* (2013.01); *F02D 41/0077* (2013.01); *F02D 41/04* (2013.01); *F02D 41/14* (2013.01); *F02D 43/00* (2013.01); *F02D 45/00* (2013.01); *F02M 25/08* (2013.01); *F02M 26/46* (2016.02); *F02P 5/15* (2013.01); *F02P 5/1516* (2013.01); *F02D 2200/0418* (2013.01)

(58) Field of Classification Search
USPC ..... 123/568.11, 406.48
See application file for complete search history.

(56) References Cited

U.S. PATENT DOCUMENTS

| | | | | |
|---|---|---|---|---|
| 7,715,976 | B1 | 5/2010 | Xiao et al. | |
| 2002/0129797 | A1* | 9/2002 | Hayashi | F02D 41/0032 123/520 |
| 2003/0226544 | A1* | 12/2003 | Nakamori | F02D 41/0072 123/406.48 |
| 2005/0072404 | A1* | 4/2005 | Cullen | F02D 41/1475 123/399 |
| 2010/0199959 | A1* | 8/2010 | Brown | F02D 41/0052 123/672 |
| 2010/0274463 | A1* | 10/2010 | Itoga | F02D 13/0246 701/102 |
| 2010/0332075 | A1* | 12/2010 | Clarke | F02D 41/0072 701/33.4 |
| 2013/0238218 | A1* | 9/2013 | Wiggins | F02M 35/10393 701/102 |
| 2014/0222318 | A1* | 8/2014 | Ramappan | F02D 41/0072 701/108 |
| 2014/0316676 | A1* | 10/2014 | Pursifull | F02P 5/045 701/103 |
| 2015/0101327 | A1 | 4/2015 | Clark et al. | |
| 2015/0322867 | A1 | 11/2015 | Ito et al. | |

FOREIGN PATENT DOCUMENTS

| | | | |
|---|---|---|---|
| JP | 2005-48704 | A | 2/2005 |
| JP | 2011-99417 | A | 5/2011 |
| JP | 2013-96332 | A | 5/2013 |
| WO | WO 2004/044406 | A1 | 5/2004 |
| WO | WO 2013/178420 | A1 | 12/2013 |
| WO | WO 2014/098010 | A1 | 6/2014 |

OTHER PUBLICATIONS

Japanese-language Written Opinion (PCT/ISA/237) issued in PCT Application No. PCT/JP2016/069960 dated Sep. 20, 2016 (4 pages).
Japanese-language Office Action issued in counterpart Japanese Application No. 2017-528618 dated Sep. 4, 2018 with unverified English translation (five pages).
Extended European Search Report issued in counterpart European Application No. 16824341.8 dated Feb. 11, 2019 (six (6) pages).

* cited by examiner

CONTROL APPARATUS FOR INTERNAL COMBUSTION ENGINE

TECHNICAL FIELD

The present invention relates to control of an internal combustion engine using humidity sensor values obtained from a plurality of humidity sensors that measures humidity in an intake pipe of the internal combustion engine, and that are disposed in the intake pipe.

BACKGROUND ART

Fuel consumption and exhaust emissions regulations on automobiles and other vehicles are becoming more and more stringent in these years and the future trend is toward even more stringent regulations. There is growing interest particularly in fuel consumption because of such issues as escalating gasoline prices, effect on global warming, and depletion of energy resources.

Under these circumstances, various technological developments are underway in many countries of the world for the improved vehicle fuel consumption. Examples of the technologies that have been developed include electric power drive represented by hybrid and electric vehicles and improved efficiency of the internal combustion engine represented by improved compression ratios, more accurately controlled fuel injection amount, and external EGR.

In terms of EGR, aims of introducing the EGR are to reduce work performed outside the system by a piston (pump loss) by reducing intake pipe vacuum (a difference between cylinder pressure during an intake stroke and atmospheric pressure) under a condition in which an output from the internal combustion engine is small and to reduce exhaust loss by controlling abnormal combustion (detonation) under a condition in which the output from the internal combustion engine is relatively large. Thus, due to a mounting need for improved fuel economy from vehicles, a need exists for a greater amount of EGR introduced to the intake pipe.

PTL 1 discloses an exemplary method for estimating an EGR amount (rate) to be recirculated from the exhaust pipe to the intake pipe.

With the more accurately controlled fuel injection amount, a purge system is known for controlling the internal combustion engine, in which activated carbon in a canister adsorbs fuel evaporative emissions and the emissions are diluted with atmosphere before flowing into the intake pipe, so that constant pressure can be maintained in the fuel tank. The purging allows the fuel evaporative emissions contained in purge gas to be introduced into the combustion chamber. Thus, reducing the fuel injection amount using the fuel injection valve is necessary to prevent the air-fuel ratio from being deviated. PTL 2 discloses an exemplary method for estimating a purge air-fuel ratio.

CITATION LIST

Patent Literature

PTL 1: JP 2001-280202 A
PTL 2: JP H10-141114 A

SUMMARY OF INVENTION

Technical Problem

PTL 1 discloses a method for estimating an EGR flow rate on the basis of an EGR valve opening and differential pressure across the EGR valve. The EGR flow rate is proportional to the EGR valve opening (opening area) and the differential pressure. The EGR flow rate is greater with an increasing EGR valve opening when the differential pressure remains constant. The EGR flow rate increases with an increasing differential pressure when the EGR valve opening remains constant. Use of this method enables the EGR flow rate to be estimated.

The EGR flow rate estimation method disclosed in PTL 1, however, results in variations in the EGR valve opening (variations in the opening area) being directly incorporated in estimated results of the EGR flow rate. Accuracy of the EGR flow rate estimated results is degraded with time due to a deteriorated EGR valve that causes the EGR valve opening to vary. Ignition timing of the internal combustion engine is corrected using an EGR rate. An estimated EGR rate higher than an actual EGR rate results in an excessively advanced angle, which can lead to detonation. In contrast, an estimated EGR rate lower than the actual EGR rate results in an excessively retarded angle, which can lead to misfire. When a target EGR rate is low, the EGR flow rate estimation method involving variations in the EGR valve opening may fall within a permissible accuracy range. When the target EGR rate is high, however, accuracy required for the estimated EGR rate is extremely stringent, so that the EGR flow rate estimation method incorporating the EGR valve opening may not be able to satisfy the accuracy requirements with a high target EGR rate.

PTL 2 describes an air-fuel ratio fluctuation rate estimation unit that estimates a fluctuation rate of the air-fuel ratio involved in turning ON and OFF purging, and a method for correcting a fuel injection amount to be achieved by a fuel injection valve during purging on the basis of the fluctuation rate estimated by the air-fuel ratio fluctuation rate estimation unit. According to this method, the air-fuel ratio varies with fuel evaporative emissions contained in the purge gas depending on whether the purging is performed, so that the injection amount to be achieved by the fuel injection valve is corrected using the variation to thereby bring the air-fuel ratio to a target value.

In internal combustion engines, to prevent fuel evaporative emission vaporized from the fuel tank from being released to the atmosphere, the fuel evaporative emissions are adsorbed by activated carbon in the canister and a purge control valve in a purge introduction pipe is opened in a predetermined driving range, to thereby purge the fuel evaporative emissions into the intake system while diluting the emissions with fresh air in the atmosphere. Any change in the air-fuel ratio caused by the purging of the fuel evaporative emissions is corrected by an ECU that increases or decreases the fuel injection amount to be achieved by the fuel injection valve in accordance with a feedback signal from an air-fuel ratio sensor disposed in the exhaust system.

The method disclosed in PTL 2, however, may lead to a reduced conversion efficiency of a catalyst with a large change in the air-fuel ratio during purging. The amount of fuel evaporative emissions adsorbed by the activated carbon in the canister is not constant. A purge gas concentration varies with the amount of fuel evaporative emissions and the change in the air-fuel ratio is greater with higher purge gas concentrations. Thus, even when the air-fuel ratio is corrected using the feedback signal from the air-fuel ratio sensor, a correction amount of the air-fuel ratio cannot be fixed in advance, so that a reduced conversion efficiency of the catalyst results when the change in the air-fuel ratio is so large as to cause the correction to accommodate the change.

Solution to Problem

To solve the foregoing problems, an aspect of the present invention provides a control apparatus for an internal combustion engine that includes an introduction port that is disposed in an intake pipe and through which a gas other than fresh air is introduced to the intake pipe; and humidity sensors disposed upstream and downstream, respectively, of the introduction port. The control apparatus estimates an EGR rate in the intake pipe using detection values of the respective humidity sensors when the gas other than fresh air is an EGR gas. The control apparatus estimates a purge air-fuel ratio in the intake pipe using the detection values of the respective humidity sensors when the gas other than fresh air is a purge gas.

Advantageous Effects of Invention

According to the invention, the humidity sensors are disposed, in the intake pipe, upstream and downstream of the connection with the EGR pipe and the EGR rate in the intake pipe is estimated using the detection values of the respective humidity sensors. The arrangement enables highly accurate estimation of the EGR rate regardless of whether the EGR valve is deteriorated.

According to the invention, the humidity sensors are disposed, in the intake pipe, upstream and downstream of the connection with the purge introduction pipe and the purge air-fuel ratio in the intake pipe is estimated using the detection values of the respective humidity sensors. This arrangement enables a correction of the fuel injection amount at the fuel injection valve to be made by quickly responding to a fuel vapor amount in the purge gas. Thus, conversion efficiency of a catalyst can be prevented from being reduced.

The objects, configurations, and advantageous effects of the present invention other than those described above will be apparent to those skilled in the art from the following detailed description of the embodiments.

DESCRIPTION OF EMBODIMENTS

Embodiments of the present invention will hereinafter be described with reference to the accompanying drawings.

First Embodiment

A first embodiment of the present invention will be described below with reference to the accompanying drawings.

Figure 1:
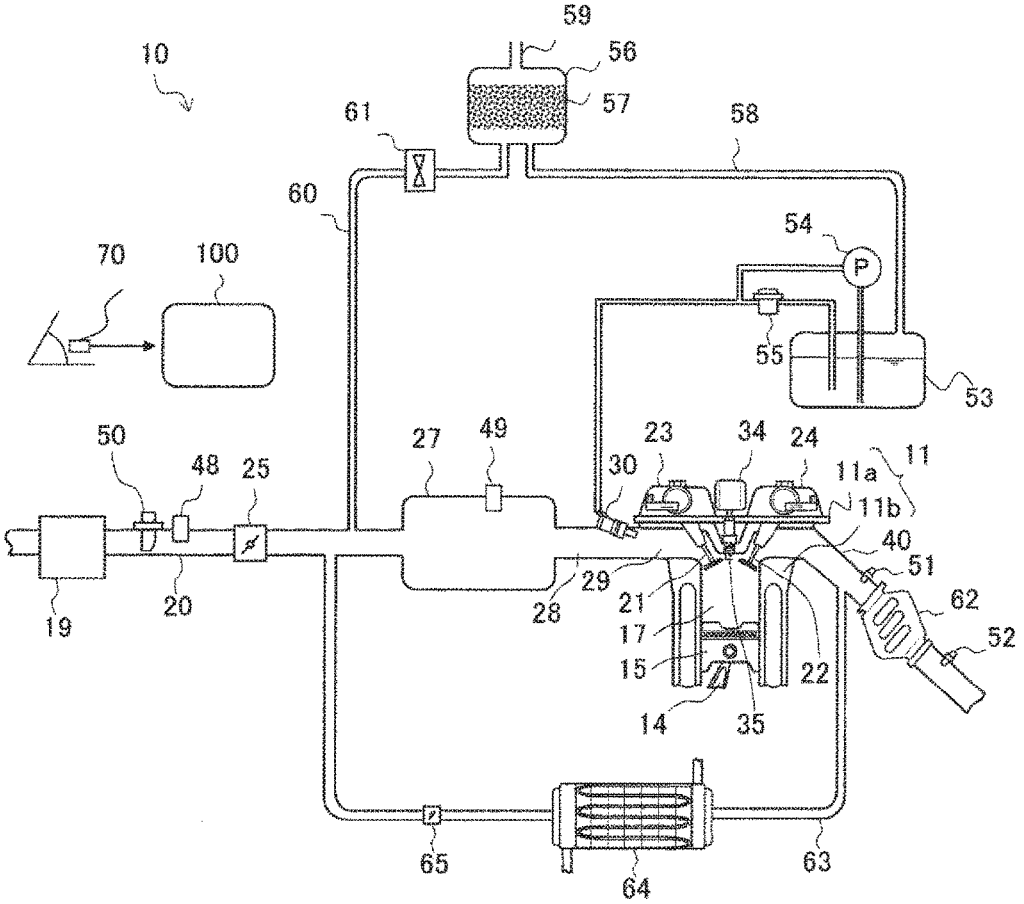
FIG. 1 is a general configuration diagram illustrating an internal combustion engine in which a control apparatus for an internal combustion engine is mounted.

FIG. 1 is a general configuration diagram illustrating an internal combustion engine in which a control apparatus for an internal combustion engine relating to the present invention is mounted.

This internal combustion engine 10 is a spark ignition, multi-cylinder internal combustion engine including, for example, four cylinders. The internal combustion engine 10 includes cylinders 11 and pistons 15. The cylinders 11 each include a cylinder head 11*a* and a cylinder block 11*b*. The pistons 15 are each slidably inserted in each of the cylinders 11. The pistons 15 are each connected with a crankshaft (not illustrated) via a connecting rod 14. A combustion chamber 17 including a ceiling portion having a predetermined shape is formed at a position superior to each of the pistons 15. An ignition plug 35 is disposed so as to face the combustion chamber 17 of each cylinder. An ignition coil 34 supplies the ignition plug 35 with a high-voltage ignition signal.

The combustion chamber 17 communicates with an intake pipe 20 that includes an air cleaner 19, a throttle valve 25, a collector 27, an intake manifold 28, and an intake port 29. Air required for burning fuel flows through the intake pipe 20 and is drawn into the combustion chamber 17 of each cylinder via an intake valve 21 driven to open or close by an intake camshaft 23 disposed at an end portion of the intake port 29 that serves as a downstream end of the intake pipe 20. In addition, a fuel injection valve 30 that injects fuel toward the intake port 29 is provided for each cylinder in the intake manifold 28 of the intake pipe 20.

An air flow sensor 50 that detects a flow rate of intake air is disposed downstream of the air cleaner 19 of the intake pipe 20. A bridge circuit is formed in the air flow sensor 50 such that the value of current flowing through a hot wire (heating resistor) disposed in an intake air flow to be measured increases with an increasing intake air amount (mass flow rate) and the value of current flowing through the hot wire decreases with a decreasing intake air amount. The value of the heating resistance current that flows through the hot wire of the air flow sensor 50 is extracted as a voltage signal and transmitted to an engine control unit (ECU) 100.

A mixture of air drawn in through the intake pipe 20 and fuel injected from the fuel injection valve 30 is drawn into the combustion chamber 17 through the intake valve 21 and burned by spark ignition by the ignition plug 35 connected with the ignition coil 34. An exhaust gas after combustion in the combustion chamber 17 is exhausted from the combustion chamber 17 via an exhaust valve 22 that is driven to open or close by an exhaust camshaft 24. The exhaust gas is then discharged into the outside atmosphere through an exhaust passage 40 that includes an exhaust port, an exhaust manifold, and an exhaust pipe (not illustrated).

A three-way catalyst 62 for exhaust gas purification is disposed in the exhaust passage 40. The three-way catalyst 62 is composed of, for example, an alumina or ceria carrier coated with, for example, platinum or palladium. An air-fuel ratio sensor 51 is disposed upstream of the three-way catalyst 62 and an oxygen sensor 52 is disposed downstream of the three-way catalyst 62. The air-fuel ratio sensor 51 as an embodiment of an air-fuel ratio detector has an output characteristic linear to an air-fuel ratio before the catalyst. The oxygen sensor 52 outputs a switching signal for determining whether an air-fuel ratio after the catalyst is richer or leaner than a stoichiometric air-fuel ratio.

Additionally, an EGR pipe 63 is provided for returning part of the exhaust gas from a point upstream of the three-way catalyst 62 of the exhaust passage 40 to a point upstream of the collector 27 of the intake pipe 20. Additionally, an EGR cooler 64 for cooling EGR and an EGR valve 65 for controlling an EGR flow rate are disposed at respective appropriate positions in the EGR pipe 63. In addition, a temperature sensor 45 that measures temperature of coolant circulating through the internal combustion engine is provided, though not illustrated. In the embodiment, the EGR pipe 63 is disposed upstream of the three-way catalyst 62. The EGR pipe 63 may nonetheless be disposed downstream of the three-way catalyst 62.

The fuel injection valve 30 disposed in each of the cylinders of the internal combustion engine 10 is connected with a fuel tank 53 via a fuel pipe (not illustrated). Fuel in the fuel tank 53 undergoes fuel pressure regulation to achieve a predetermined fuel pressure by a fuel supply mechanism that includes a fuel pump 54 and a fuel pressure regulator 55 before being supplied to the fuel injection valve 30.

Fuel vapor in the fuel tank 53 is adsorbed by activated carbon 57 in a charcoal canister 56 via a canister pipe 58 and flows, together with fresh air introduced from a fresh air introduction pipe 59, into a connection between a purge introduction pipe 60 and the intake pipe 20. A purge control valve 61 that adjusts a purge flow rate is disposed in the purge introduction pipe 60. The purge flow rate is adjusted using vacuum in the intake pipe 20.

The fuel injection valve 30 to which fuel with the predetermined fuel pressure has been supplied is driven to open by a fuel injection pulse signal having a duty ratio (pulse width:equivalent to valve opening time) variable depending on operating conditions, such as engine load, supplied from the ECU 100. The fuel injection valve 30 injects an amount of fuel corresponding to the valve opening time toward the intake port 29.

It is noted that the ECU 100 includes a microprocessor that performs various types of control for the internal combustion engine 10, e.g., fuel injection control (air-fuel ratio control) by the fuel injection valve 30 and ignition timing control by the ignition plug 35.

The intake pipe 20 is provided with a first humidity sensor 48 and a second humidity sensor disposed therein. The first humidity sensor 48 is disposed upstream of an introduction port through which gases other than fresh air flow in the intake pipe 20 (more preferably, upstream of the throttle valve 25 at which pressure in the intake pipe 20 is substantially equal to the atmosphere). The second humidity sensor is disposed downstream of the introduction port through which gases other than fresh air flows in the intake pipe 20. These humidity sensors measure humidity of a fluid flowing through the intake pipe and transmit measured humidity signals to the ECU 100. It is noted that the first humidity sensor 48 and the second humidity sensor 49 are each capable of detecting relative humidity. A temperature sensor and a pressure sensor (not illustrated) are incorporated in each chip that detects humidity. These humidity sensors transmit to the ECU 100 the relative humidity together with temperature and pressure information. Additionally, the first humidity sensor 48 may be the air flow sensor 50 that incorporates a function of measuring humidity. The first humidity sensor 48 in the present embodiment is exemplarily disposed between the air flow sensor 50 and the throttle valve 25.

Signals obtained from the various sensors including the air flow sensor 50, the first humidity sensor 48, the second humidity sensor 49, the air-fuel ratio sensor 51, and the oxygen sensor 52 are transmitted to the ECU 100 (signal lines not illustrated). Additionally, a signal obtained from an accelerator operation amount sensor 70 is transmitted to the ECU 100. The accelerator operation amount sensor 70 detects a depression amount of an accelerator pedal, specifically, an accelerator operation amount. The ECU 100 calculates a torque requirement on the basis of an output signal from the accelerator operation amount sensor 70. Specifically, the accelerator operation amount sensor 70 is used as a torque requirement detection sensor that detects the torque requirement for the internal combustion engine.

The ECU 100 further calculates a rotating speed of the internal combustion engine on the basis of an output signal from a crank angle sensor. The ECU 100 optimally calculates main operation amounts of the internal combustion engine, including the air flow rate, fuel injection amount, ignition timing, and fuel pressure, on the basis of the operating conditions of the internal combustion engine obtained from the outputs of the abovementioned various sensors.

Figure 2:
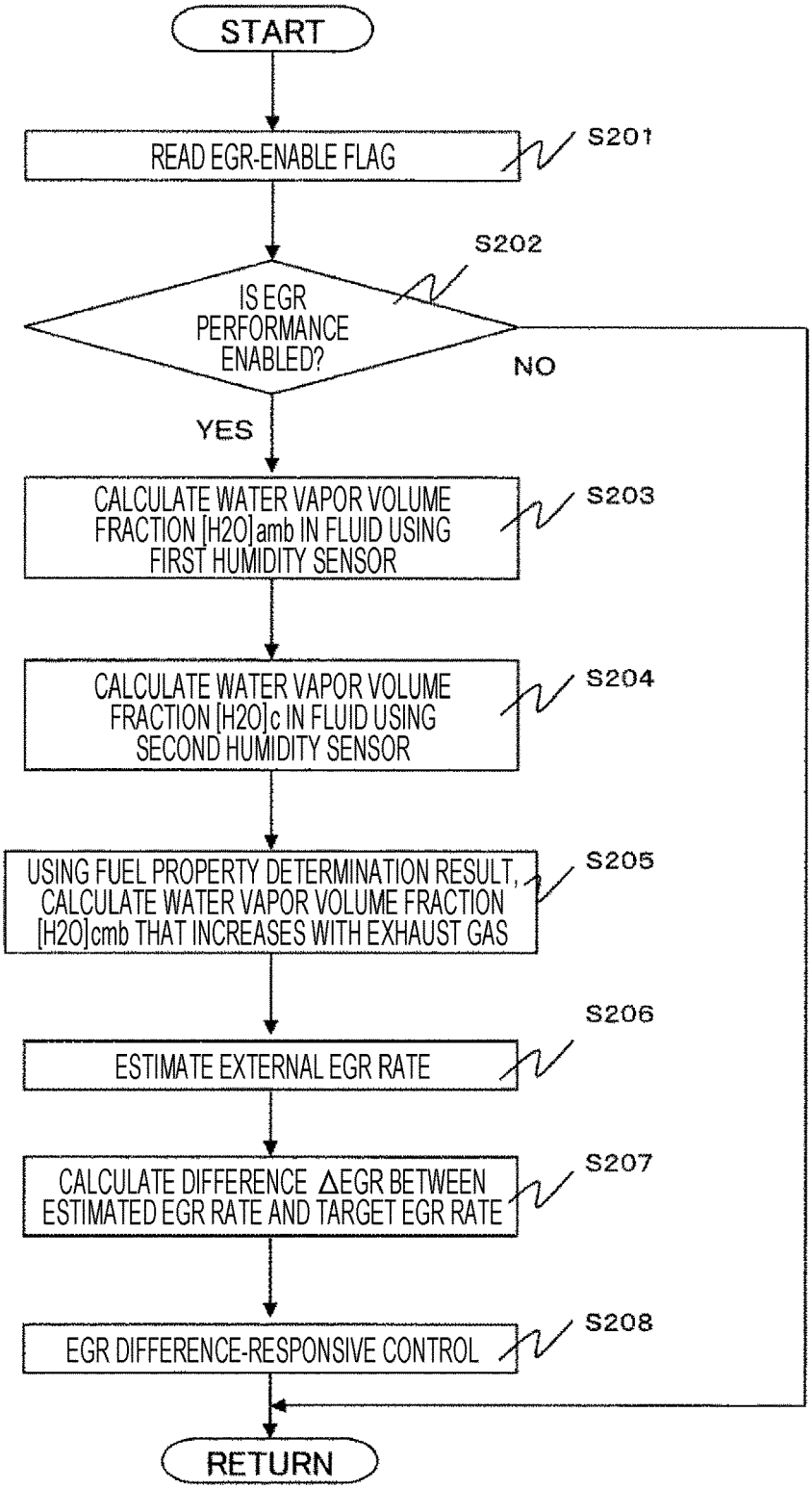
FIG. 2 is a flowchart for estimating an EGR rate.

FIG. 2 is a flowchart for estimating an external EGR rate inside the collector 27 using detection values of the first humidity sensor 48 and the second humidity sensor 49 disposed upstream and downstream, respectively, of a connection between the intake pipe 20 and the EGR pipe 63 and for controlling the internal combustion engine on the basis of the estimated EGR rate.

At S201, an EGR-enable flag that indicates whether performance of EGR is enabled is read and a subsequent step is performed. Generally, cases of disabling the EGR includes: water temperature not reaching an EGR performance temperature; a rotating speed at which, or a load condition in which, the EGR is not performed; and a fail-safe condition.

At S202, it is determined whether the EGR-enable flag is true (enabled) or false (disabled). If it is determined that the flag is false (disabled), the EGR rate is not to be estimated. If it is determined that the flag is true (enabled), the subsequent step is performed.

At S203, the signal detected by the first humidity sensor 48 is read and a water vapor volume fraction [H2O] amb in a fluid (in this case, fresh air) is calculated. Specifically, signals indicating relative humidity RHamb, pressure Pamb, and temperature Tamb are read from the first humidity sensor 48.

Next, saturated water vapor pressure Pw at the temperature Tamb is calculated from the temperature Tamb. To calculate the saturated water vapor pressure Pw, a table may be prepared depicting a relation between temperature and saturated water vapor pressure. Alternatively, a Tetens expression as shown in expression (1) below may be used for the calculation. In expression (1), Pw and Tamb are in units of [hPa] and [° C.], respectively.

[Math. 1]

$$P_w=6.1078\times10^{(7.5\times T_{amb}/237.3+T_{amb}))} \quad \text{Expression (1)}$$

Using the saturated water vapor pressure Pw and the relative humidity RHamb, water vapor pressure Pwa is calculated. The water vapor pressure Pwa is calculated using expression (2), where RHamb and Pwa are in units of [% RH] and [hPa], respectively.

[Math. 2]

$$P_{wa} = P_w \times \frac{RH_{amb}}{100} \quad \text{Expression (2)}$$

Then, using the water vapor pressure Pwa and the pressure Pamb, and using expression (3), the water vapor volume fraction [H2O] amb in a fluid (in this case, fresh air) is calculated. Then, the subsequent step is performed.

[Math. 3]

$$[H_2O]_{amb} = \frac{P_{wa}}{P_{amb}} \quad \text{Expression (3)}$$

At S204, the signal detected by the second humidity sensor 49 is read and a water vapor volume fraction [H2O] c in a fluid (in this case, a gaseous mixture of fresh air and EGR gas) is calculated. Specifically, signals indicating relative humidity RHc, pressure Pc, and temperature Tc are read from the second humidity sensor 49.

Next, the saturated water vapor pressure Pw at the temperature Tc is calculated from the temperature Tc. To calculate the saturated water vapor pressure Pw, a table may be prepared depicting a relation between temperature and the saturated water vapor pressure. Alternatively, a calculation made be made using expression (1) in which Tamb is replaced by Tc. As with Tamb, Tc is in units of [° C.].

Using the saturated water vapor pressure Pw and the relative humidity RHc, water vapor pressure Pwc is calculated. The water vapor pressure Pwc is calculated using expression (4), where RHc and Pwc are in units of [% RH] and [hPa], respectively.

[Math. 4]

$$P_{wc} = P_w \times \frac{RH_c}{100} \quad \text{Expression (4)}$$

Then, using the water vapor pressure Pwc and the pressure Pc, and using expression (5), the water vapor volume fraction [H2O]c in a fluid (in this case, a gaseous mixture of fresh air and EGR gas) is calculated. Then, the subsequent step is performed.

[Math. 5]

$$[H_2O]_c = \frac{P_{wc}}{P_c} \quad \text{Expression (5)}$$

At S205, a current fuel property determination result is read. The fuel property determination result may be based on determination using regular-grade and high octane fuels, or on the RON (octane number).

Figure 3:
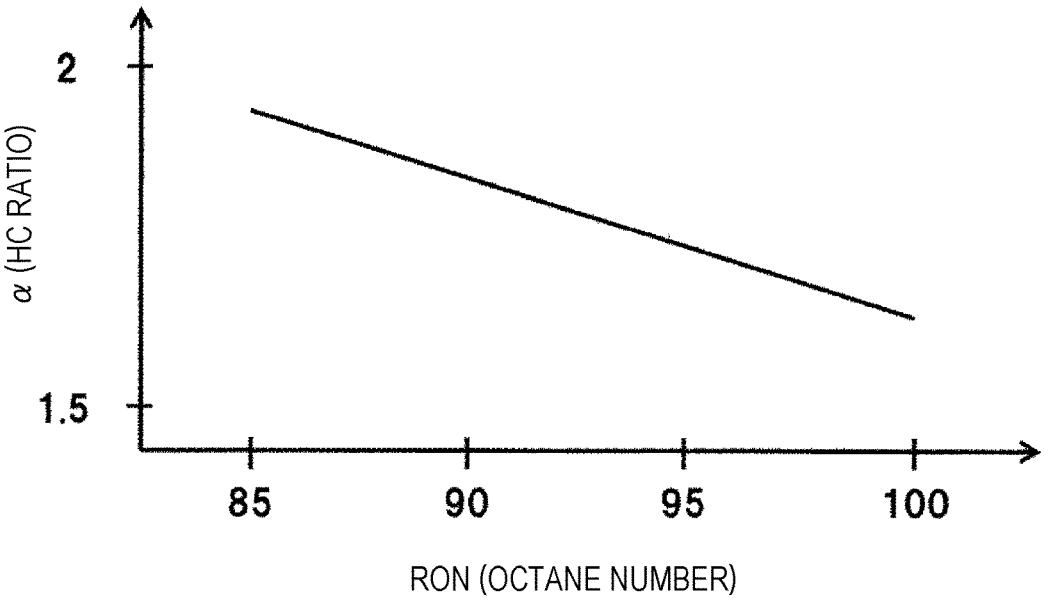
FIG. 3 is a chart depicting a relation between an octane number and an HC ratio.
Figure 4:
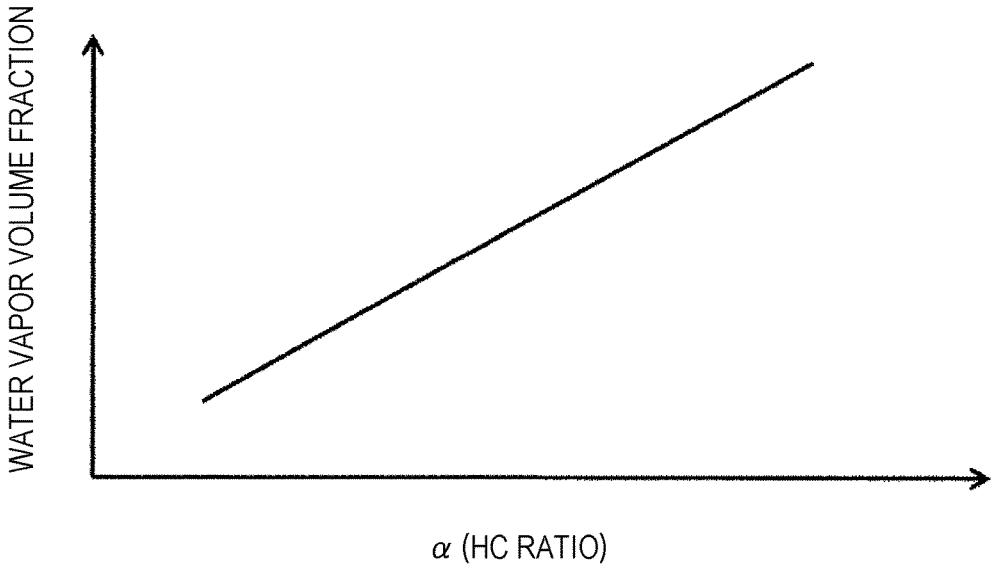
FIG. 4 is a chart depicting a relation between the HC ratio and a water vapor volume fraction in exhaust gas.

FIG. 3 depicts a relation between an octane number and α as an HC ratio. The HC ratio is a ratio of H to a saturated hydrocarbon C as a fuel component. The HC ratio tends to be smaller at an increasing octane number. In general, the high octane fuel tends to have an octane number higher than an octane number of the regular-grade fuel.

Thus, when the fuel property is determined using the octane number, the HC ratio can be obtained from the relation depicted in FIG. 3. When the fuel property is determined using regular-grade and high octane fuels, the HC ratio is assigned in advance for each of the regular-grade and high octane fuels to thereby obtain the HC ratio.

With the HC ratio fixed, ratios of gas compositions generated when the fuel burns can be obtained, so that a water vapor volume fraction [H2O] cmb in the exhaust gas can be found.

Assume that nitrogen and oxygen in the air is 79 to 21 in volume ratio. Then, expression (6) is a chemical formula for combustion of fuel CnHm.

[Math. 6]

$$C_nH_m + \left(n + \frac{m}{4}\right)\left(O_2 + \frac{79}{21}N_2\right) \rightarrow nCO_2 + \frac{m}{2}H_2O + \left(n + \frac{m}{4}\right)\times\frac{79}{21}N_2 \quad \text{Expression (6)}$$

Where, let α be the HC ratio, α is given by expression (7).

[Math. 7]

$$\alpha = \frac{H}{C} = \frac{m}{n} \quad \text{Expression (7)}$$

Substituting expression (7) for expression (6) gives expression (8).

[Math. 8]

$$C_nH_{\alpha\times n} + \left(\frac{4+\alpha}{4}\times n\right)\left(O_2 + \frac{79}{21}N_2\right) \rightarrow nCO_2 + \frac{\alpha\times n}{2}H_2O + \left(\frac{4+\alpha}{4}\times n\right)\times\frac{79}{21}N_2 \quad \text{Expression (8)}$$

From expression (8), the ratio of volume fractions of CO2, H2O, and N2 in the exhaust gas is given by expression (9).

[Math. 9]

$$CO_2:H_2O:N_2 = n:\frac{\alpha\times n}{2}:\frac{4+\alpha}{4}\times n\times\frac{79}{21} = 1:\frac{\alpha}{2}:\frac{4+\alpha}{4}\times\frac{79}{21} \quad \text{Expression (9)}$$

Thus, the water vapor volume fraction [H2O]cmb in the exhaust gas generated by combustion is given by expression (10). The value of the HC ratio α is applied to expression

(10) to calculate the water vapor volume fraction [H2O]cmb in the exhaust gas generated by combustion. Then, the subsequent step is performed.

[Math. 10]

$$[H_2O]_{cmb} = \frac{\frac{\alpha}{2}}{1 + \frac{\alpha}{2} + \frac{4+\alpha}{4} \times \frac{79}{21}} \quad \text{Expression (10)}$$

At S206, an estimated EGR rate Regr in the collector 27 is calculated using the water vapor volume fractions obtained by expressions (3), (5), and (10) and using expression (11) below. Then, the subsequent step is performed. It is noted that Regr is in units of [%].

[Math. 11]

$$R_{egr} = \frac{[H_2O]_c - [H_2O]_{amb}}{[H_2O]_{cmb}} \times 100 \quad \text{Expression (11)}$$

At S207, a difference ΔEGR between the estimated EGR rate Regr calculated using expression (11) and a target EGR rate Rtegr that has previously been set on the basis of the rotating speed, load, and other operating conditions of the internal combustion engine is calculated using expression (12). Then, the subsequent step is performed. It is noted that each of terms in expression (12) is in units of [%].

[Math. 12]

$$\Delta EGR = R_{egr} - R_{tegr} \quad \text{Expression (12)}$$

At S208, control based on the ΔEGR rate calculated at S207 is performed. Because the EGR rate is closely related to ignition timing, the ignition timing needs to be set optimally for the EGR rate being supplied. When the set ignition timing is on an advance side with respect to the optimum ignition timing, a best possible fuel economy effect cannot be obtained and detonation can occur, leading in the worst case to a broken internal combustion engine. When, in contrast, the set ignition timing is on a retard side with respect to the optimum ignition timing, a best possible fuel economy effect cannot be obtained and combustion can be unsteady, leading in the worst case to a misfire. In either case, drivability can be aggravated. Thus, drivability needs to be prevented from being aggravated using the ΔEGR result.

Figure 5:
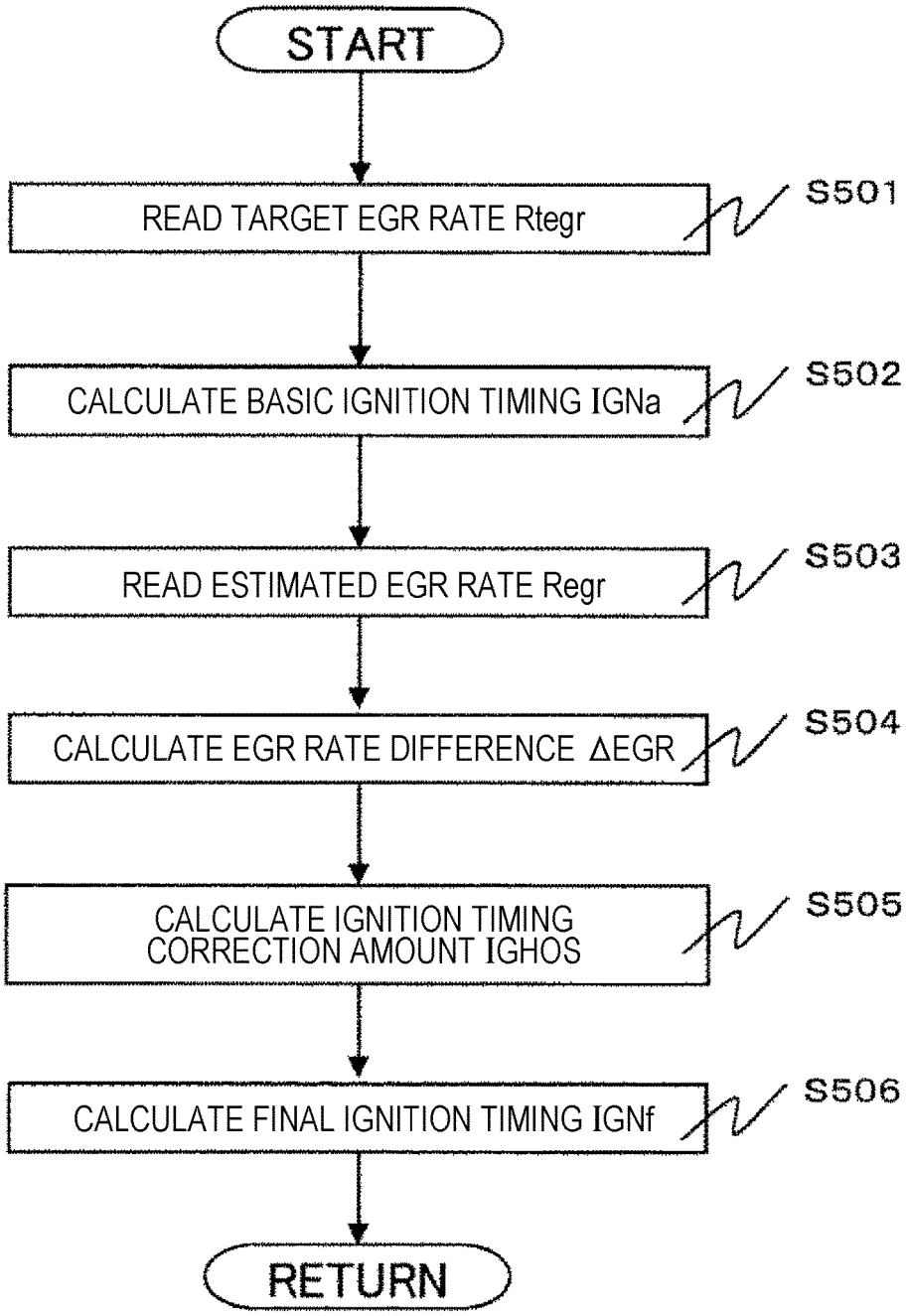
FIG. 5 is a flowchart of ignition timing correction control.

FIG. 5 is a flowchart of ignition timing correction control to be performed on the basis of the ΔEGR result.

At S501, the target EGR rate Rtegr is read and the subsequent step is performed. The target EGR rate is set on the basis of the operating condition and calculated with reference to, for example, a map having the rotating speed and the load on the internal combustion engine on the axes thereof.

At S502, basic ignition timing IGNa is calculated using the target EGR rate Rtegr and the subsequent step is performed.

At S503, the estimated EGR rate Regr is read and the subsequent step is performed. The estimated EGR rate is the result of expression (11) given previously.

At S504, an EGR rate difference ΔEGR that represents a difference between the estimated EGR rate Regr and the target EGR rate Rtegr is calculated and the subsequent step is performed. ΔEGR is calculated using expression (12) given previously.

Figure 6:
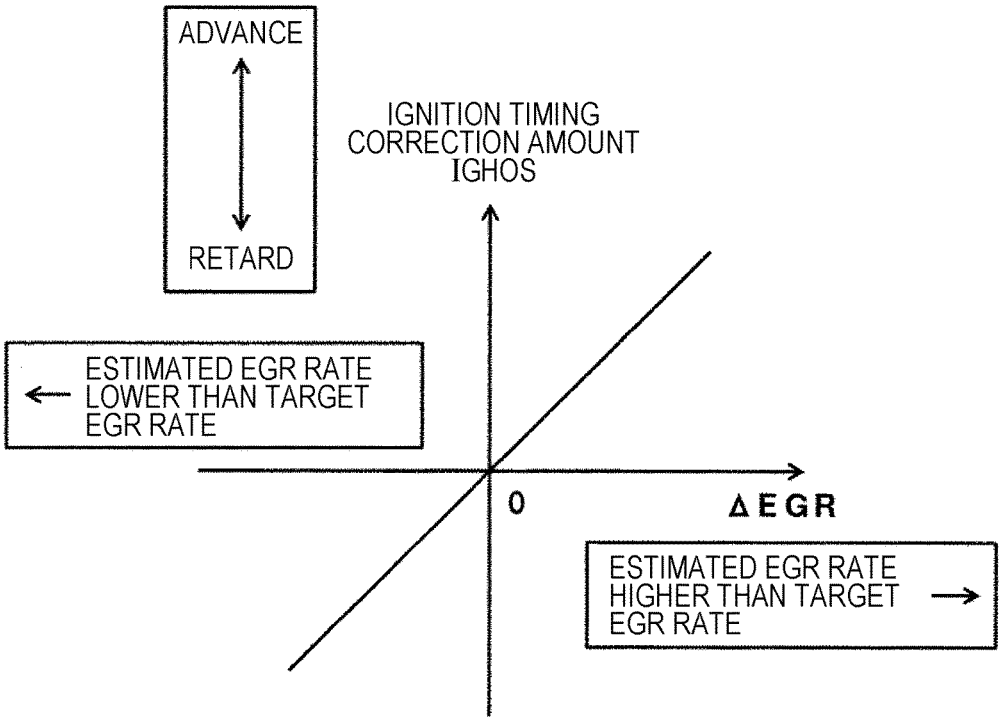
FIG. 6 is a chart depicting a relation between ΔEGR and an ignition timing correction amount.

At S505, an ignition timing correction amount IGHOS is calculated on the basis of the ΔEGR amount. FIG. 6 is a chart depicting a relation between ΔEGR and the ignition timing correction amount IGHOS.

The condition of ΔEGR>0 indicates that the estimated EGR rate is higher than the target EGR rate. Thus, the correction amount is calculated so that the ignition timing is advanced. The ignition timing correction amount is set to be greater with greater ΔEGR values. In contrast, the condition of ΔEGR<0 indicates that the estimated EGR rate is lower than the target EGR rate. Thus, the correction amount is calculated so that the ignition timing is retarded. After the ignition timing correction amount has been calculated, the subsequent step is performed.

At S506, the ignition timing correction amount IGHOS calculated at the preceding step S505 is added to the basic ignition timing IGNa before the ignition timing correction by the EGR to thereby find final ignition timing IGNf. The final ignition timing IGNf is calculated using expression (13).

[Math. 13]

$$IGN_f = IGN_a + IGHOS \quad \text{Expression (13)}$$

Performance of steps from S501 to S506 allows ignition timing optimum for the EGR rate to be set, so that the best possible fuel economy can be achieved without aggravating drivability.

Figure 7:
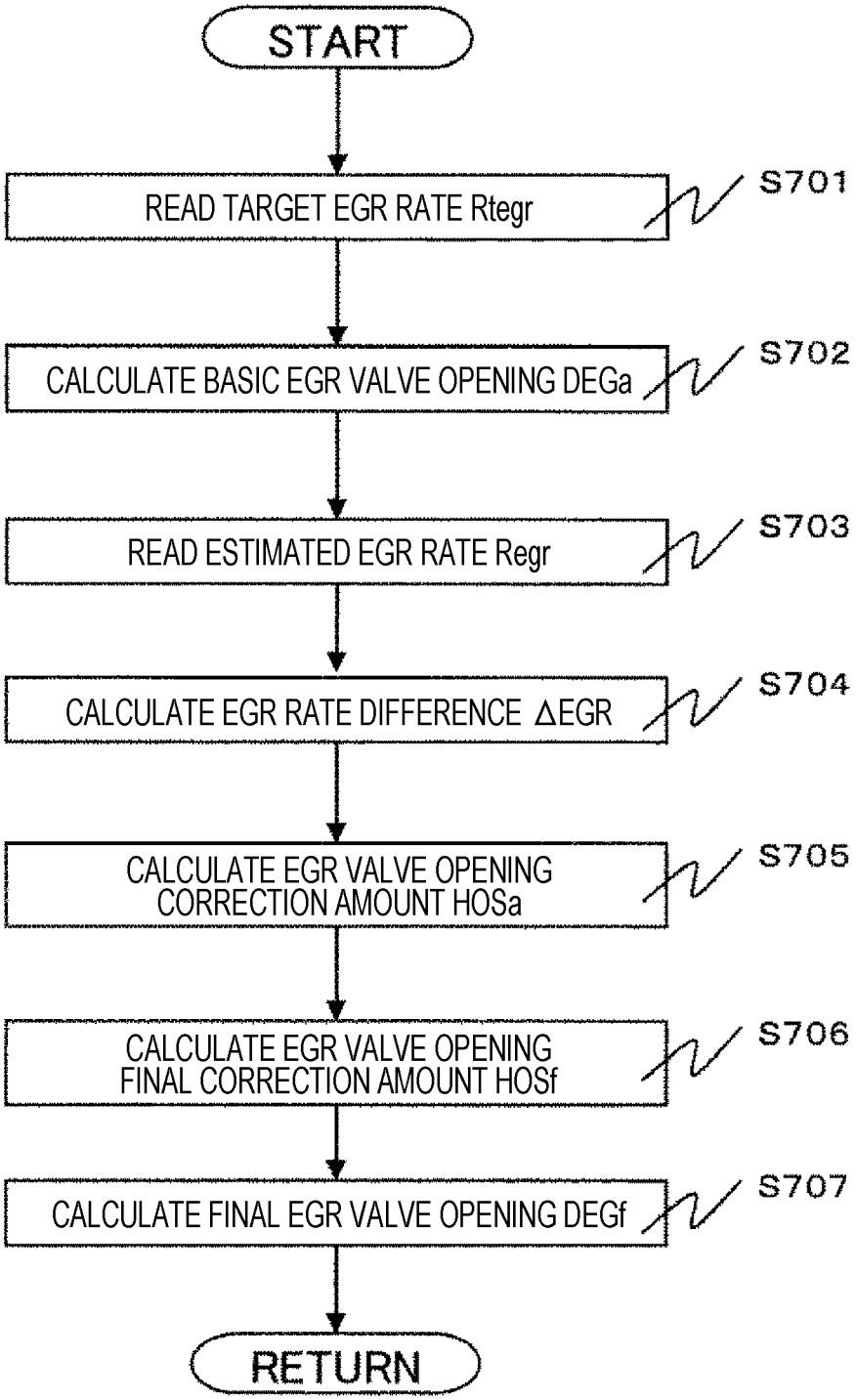
FIG. 7 is a flowchart of EGR valve opening correction control.

FIG. 7 is a flowchart of EGR valve opening correction control to be performed on the basis of the ΔEGR result.

At S701, the target EGR rate Rtegr is read and the subsequent step is performed. The target EGR rate is set on the basis of the operating condition and calculated with reference to, for example, a map having the rotating speed and the load on the internal combustion engine on the axes thereof.

At S702, a basic EGR valve opening DEGa that represents an opening degree of the EGR valve for controlling the EGR rate (flow rate) is calculated using the target EGR rate Rtegr and the subsequent step is performed.

At S703, the estimated EGR rate Regr is read and the subsequent step is performed. The estimated EGR rate is the result of expression (11) given previously.

At S704, the EGR rate difference ΔEGR that represents the difference between the estimated EGR rate Regr and the target EGR rate Rtegr is calculated and the subsequent step is performed. ΔEGR is calculated using expression (12) given previously.

Figure 8:
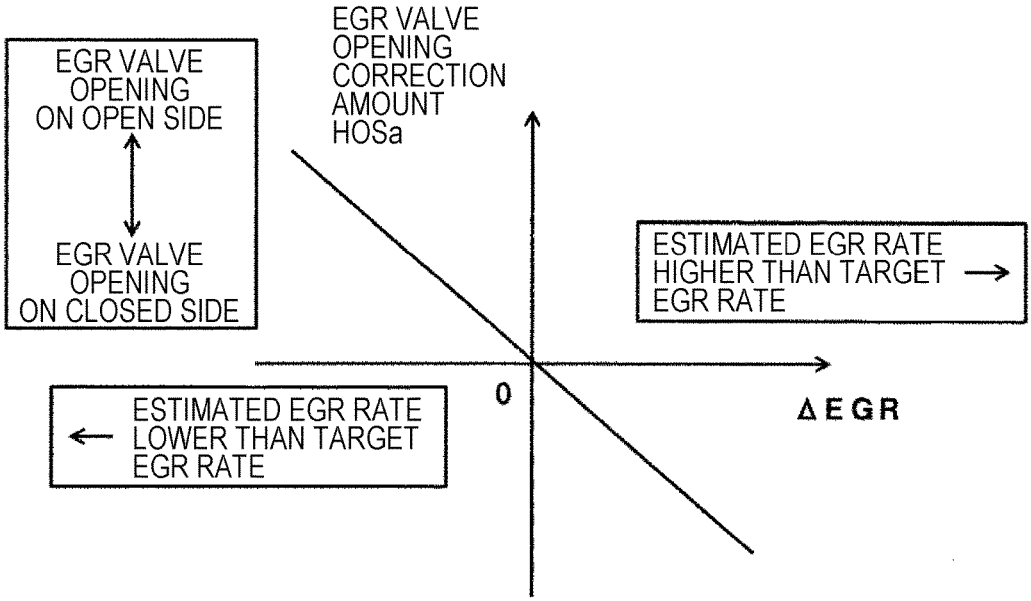
FIG. 8 is a chart depicting a relation between ΔEGR and an EGR valve opening correction amount.

At S705, an EGR valve opening correction amount HOSa is calculated on the basis of the ΔEGR amount. FIG. 8 is a chart depicting a relation between ΔEGR and the EGR valve opening correction amount HOSa.

The condition of ΔEGR>0 indicates that the estimated EGR rate is higher than the target EGR rate. Thus, the EGR valve opening correction amount is set so as to decrease the EGR rate. The correction amount is set such that the correction amount is greater in a direction in which the EGR valve is closed with ΔEGR increasing from zero to the plus side.

In contrast, the condition of ΔEGR<0 indicates that the estimated EGR rate is lower than the target EGR rate. Thus, the EGR valve opening correction amount is set so as to increase the EGR rate. The correction amount is set such that the correction amount is greater in a direction in which the EGR valve is open with ΔEGR increasing from zero to the minus side.

After the EGR valve opening correction amount HOSa has been calculated, the subsequent step is performed.

At S706, an EGR valve opening final correction amount HOSf for actually correcting the basic EGR valve opening DEGa is calculated.

HOSf is calculated using expression (14) given below.

[Math. 14]

$$HOS_f = HOS_a + HOS_z \quad \text{Expression (14)}$$

Where, HOSz is the last value of HOSf. The EGR valve opening correction amount HOSa calculated on the basis of ΔEGR is added to HOSz as the last value of the EGR valve opening final correction amount HOSf to thereby calculate HOSf. The EGR valve opening is thereby corrected until ΔEGR is zero.

At S707, a final EGR valve opening DEGf is calculated using the basic EGR valve opening DEGa and the EGR valve opening final correction amount HOSf and using expression (15).

[Math. 15]

$$DEG_f = DEG_a + HOS_f \quad \text{Expression (15)}$$

Performance of steps from S701 to S707 allows the estimated EGR rate to be set to the target EGR rate, so that the best possible fuel economy can be achieved without aggravating drivability.

Figure 9:
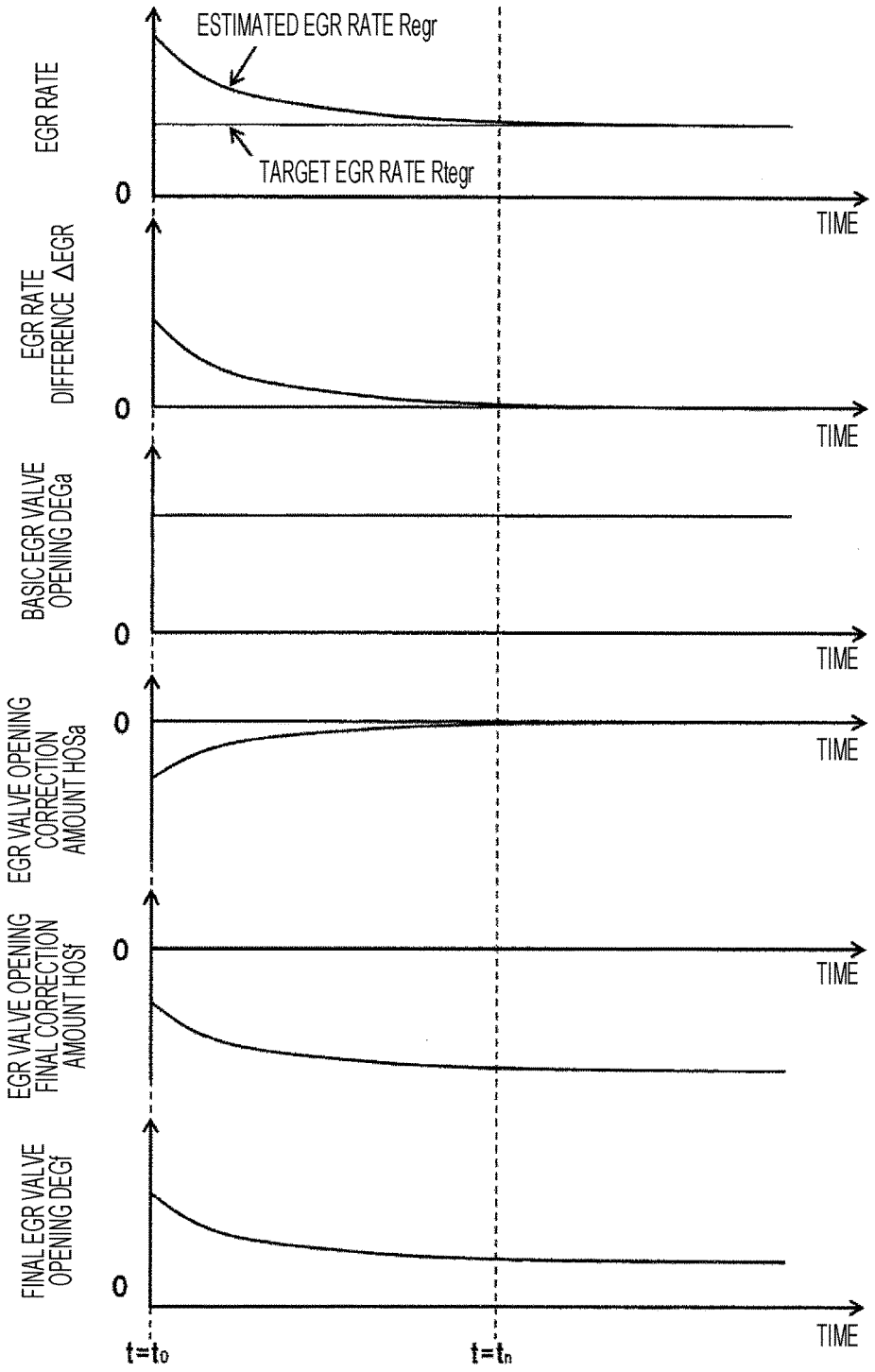
FIG. 9 is a timing chart depicting behavior of various signals relating to the EGR valve opening correction.

FIG. 9 is a timing chart depicting behavior of the EGR rate, ΔEGR, the EGR valve opening, and the EGR valve opening correction amount on the basis of the flowchart of S701 to S707.

At time t=t0, when the estimated EGR rate Regr is higher than the target EGR rate Rtegr, ΔEGR>0. The EGR valve opening correction amount HOSa and the EGR valve opening final correction amount HOSf are calculated as minus values so that the EGR valve opening is on the closed side with respect to a target EGR valve opening, thereby bringing ΔEGR to zero. The basic EGR valve opening DEGa is set on the basis of the target EGR rate. The basic EGR valve opening DEGa does not change because the target EGR rate does not change.

The target EGR valve opening DEGa is corrected by the EGR valve opening final correction amount HOSf and the final EGR valve opening DEGf decreases with time until ΔEGR equals zero.

At time t=tn, ΔEGR=0 and the EGR valve opening correction amount HOSa is zero. As depicted in expression (14), the EGR valve opening final correction amount HOSf is the last value of HOSf to which HOSa is added. Thus, the minus last value is retained even when HOSa is zero. After t=tn, a predetermined correction is applied to the target EGR valve opening DEGa and, as a result, the condition of ΔEGR=0 can be maintained.

Second Embodiment

A second embodiment will be described below with reference to the accompanying drawings. The internal combustion engine in the second embodiment has a general configuration identical to what is illustrated in FIG. 1 except that the EGR system including the EGR pipe 63, the EGR cooler 64, and the EGR valve 65 is excluded.

Figure 10:
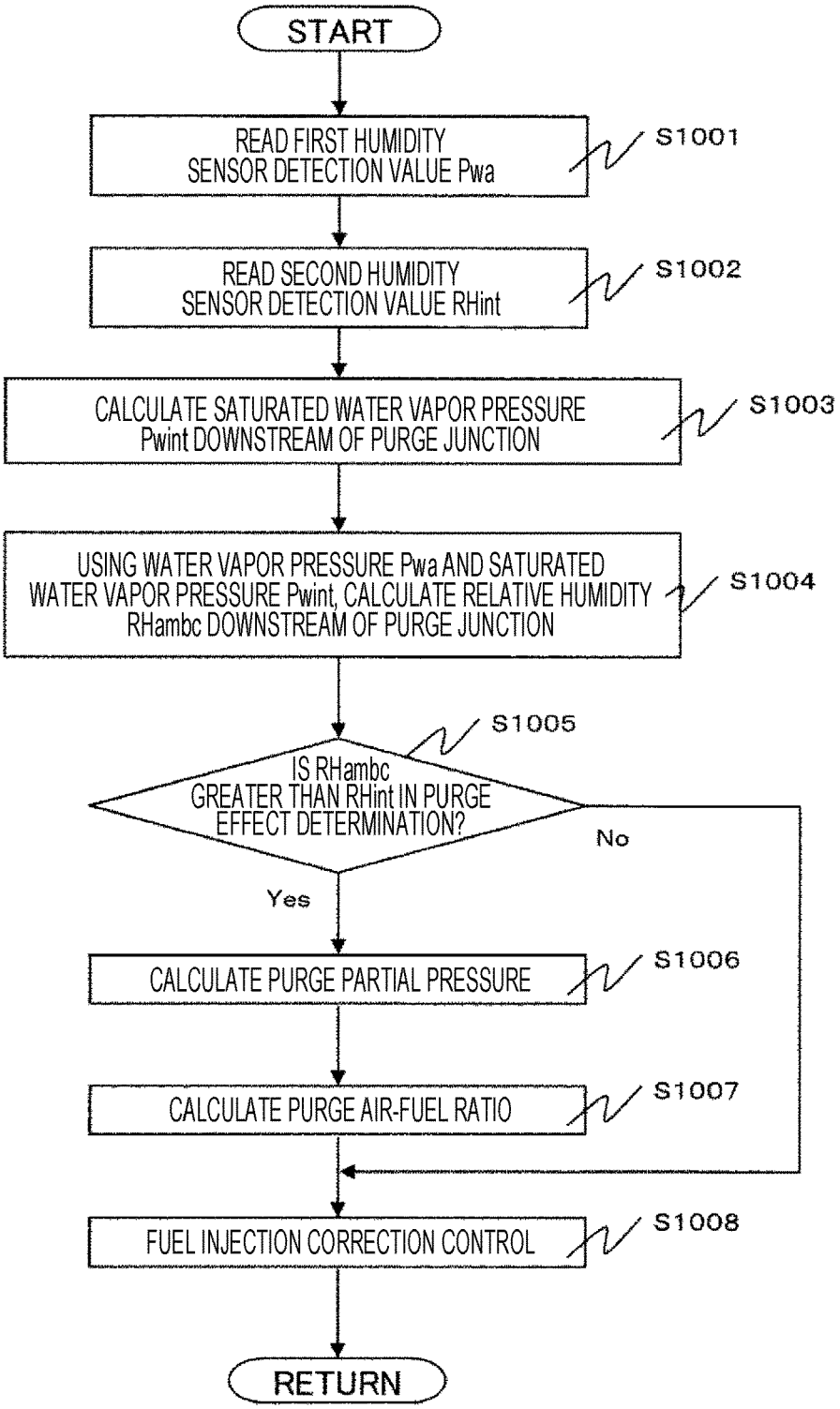
FIG. 10 is a flowchart for purge air-fuel ratio estimation and fuel injection amount correction using relative humidity.

FIG. 10 is a flowchart for controlling the fuel injection amount on the basis of a purge air-fuel ratio that represents a ratio of purge gas to fresh air at a position downstream of the connection between the intake pipe 20 and the purge introduction pipe 60 and that is estimated using relative humidity detected by the first humidity sensor 48 and the second humidity sensor 49 disposed upstream and downstream, respectively, of the connection between the intake pipe 20 and the purge introduction pipe 60.

At S1001, relative humidity RHamb, temperature Tamb, and pressure Pamb are read from the first humidity sensor 48 and the subsequent step is performed.

At S1002, relative humidity RHint, temperature Tint, and pressure Pint are read from the second humidity sensor 49 and the subsequent step is performed.

At S1003, using the read relative humidity RHamb, temperature Tamb, relative humidity RHint, and temperature Tint, saturated water vapor pressure at the detection positions of the respective humidity sensors is calculated. Let Pwamb be the saturated water vapor pressure at the position of the first humidity sensor 48 and Pwint be the saturated water vapor pressure at the position of the second humidity sensor 49. Then, the saturated water vapor pressures can be found from the temperatures Tamb and Tint using expressions (16) and (17), respectively.

[Math. 16]

$$P_{wamb} = 6.1078 \times 10^{(7.5 \times T_{amb}/(237.3 + T_{amb}))} \quad \text{Expression (16)}$$

[Math. 17]

$$P_{wint} = 6.1078 \times 10^{(7.5 \times T_c/(237.3 + T_c))} \quad \text{Expression (17)}$$

The water vapor pressure can be obtained from the saturated water vapor pressure and the relative humidity. Let Pwa be the water vapor pressure at the position of the first humidity sensor 48 and Pwc be the water vapor pressure at the position of the second humidity sensor 49. Then, the water vapor pressures can be obtained using expressions (18) and (19), respectively.

[Math. 18]

$$P_{wa} = P_{wamb} \times \frac{RH_{amb}}{100} \quad \text{Expression (18)}$$

[Math. 19]

$$P_{wc} = P_{wint} \times \frac{RH_{int}}{100} \quad \text{Expression (19)}$$

At S1004, estimated relative humidity RHabmc when the relative humidity RHamb detected by the first humidity sensor 48 reaches the position of the second humidity sensor 49 is calculated on the assumption that purging is not performed.

At this time, there is no change in water vapor partial pressure between the position of the first humidity sensor 48 and the position of the second humidity sensor 49, but the relative humidity changes with temperature. Thus, the estimated relative humidity RHambc is calculated using the water vapor pressure Pwa at the position of the first humidity sensor 48 and the saturated water vapor pressure Pwint at the position of the second humidity sensor 49, and using expression (20). Then, the subsequent step is performed.

[Math. 20]

$$RH_{ambc} = \frac{P_{wa}}{P_{wint}} \times 100 \quad \text{Expression (20)}$$

At S1005, RHambc calculated using expression (20) is compared with RHint detected by the second humidity sensor 49 and it is thereby determined whether the relative humidity of a fluid downstream of a junction is affected by purging. Specifically, the purge gas represents the fuel evaporative emissions adsorbed by the activated carbon in the canister flowing in the intake pipe while being diluted with atmosphere. Thus, the relative humidity in the purge gas decreases and the relative humidity of the fluid downstream of the junction decreases with increasing concentrations of the fuel evaporative emissions in the purge gas. Specifically, a difference between the relative humidity upstream of the junction and the relative humidity downstream of the junction is calculated using expression (21) and it is thereby determined whether the relative humidity is affected by the purge gas. If the determination is in the affirmative, S1006 is performed. If the determination is in the negative, it is considered that the purge gas does not contain the fuel evaporative emissions and fuel injection control at S1008 is performed.

[Math. 21]

$$RH_{ambc} > RH_{int\ 9} \quad \text{Expression (21)}$$

At S1006, partial pressure Pf of the purge gas downstream of the junction is calculated. The fluid downstream of the junction is composed of dry air, water vapor, and purge gas. Let Pint be total pressure of the fluid downstream of the junction, Pdc be partial pressure of the dry air, Pwc be partial pressure of the water vapor, and Pf be partial pressure of the purge gas. Then, expression (22) holds.

[Math. 22]

$$P_{int} = P_{dc} + P_{wc} + P_f \quad \text{Expression (22)}$$

The total pressure Pint is detected by the second humidity sensor 49 and the water vapor partial pressure Pwc can be found using expression (19). Thus, given the dry air partial pressure Pdc, the purge gas partial pressure Pf can be found.

It is here noted that, when condensation does not form on the intake pipe, the ratio of the dry air partial pressure to the water vapor partial pressure in the atmosphere remains constant. Thus, the ratio of the dry air partial pressure (Pamb−Pwa) to the water vapor partial pressure Pwa in the first humidity sensor 48 and the ratio of the dry air partial pressure Pdc to the water vapor partial pressure Pwc in the second humidity sensor 49 remain constant and expression (23) holds.

[Math. 23]

$$\frac{P_{amb} - P_{wa}}{P_{wa}} = \frac{P_{dc}}{P_{wc}} \quad \text{Expression (23)}$$

Arranging expression (23) with respect to the dry air partial pressure Pdc and substituting the arranging result for expression (22) allows the purge gas partial pressure Pf to be found using expression (24).

[Math. 24]

$$\begin{aligned} P_f &= P_{int} - (P_{dc} + P_{wc}) \\ &= P_{int} - \frac{P_{wc}}{P_{wa}} \times P_{amb} \end{aligned} \quad \text{Expression (24)}$$

At S1007, the purge air-fuel ratio as a mass ratio of the dry air to the fuel evaporative emissions in the fluid downstream of the junction is calculated. Let Mdc (g/mol) be molecular weight of the dry air and Mfuel (g/mol) be molecular weight of the purge fuel. Then, the purge air-fuel ratio can be found using expression (25).

[Math. 25]

$$\begin{aligned} \text{Purge air-fuel ratio} &= \frac{\frac{P_{dc}}{P_{int}} \times M_{dc}}{\frac{P_f}{P_{int}} \times M_{fuel}} \\ &= \frac{P_{dc}}{P_f} \times \frac{M_{dc}}{M_{fuel}} \end{aligned} \quad \text{Expression (25)}$$

Figure 11:
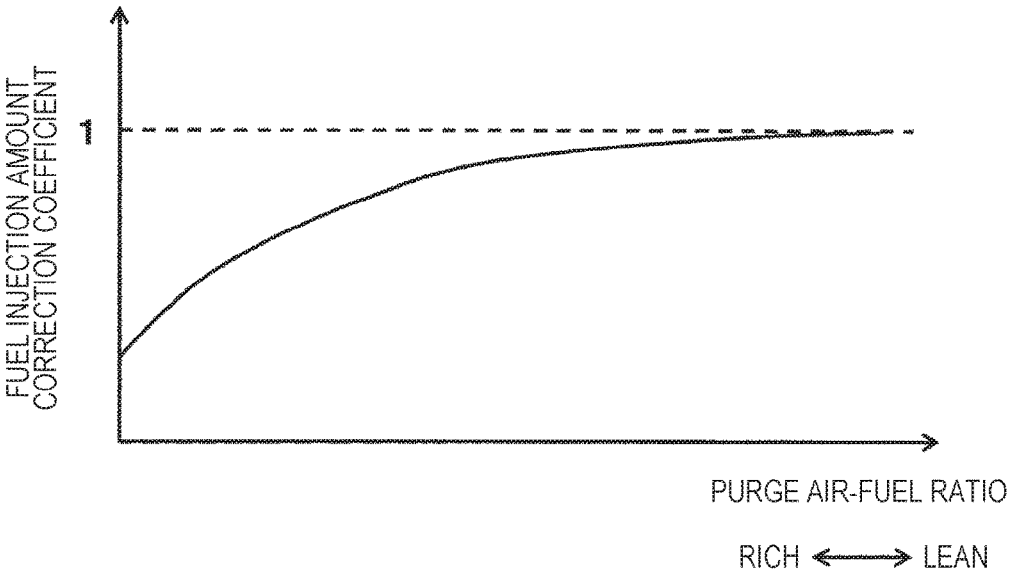
FIG. 11 is a chart depicting a relation between a purge air-fuel ratio and a fuel injection amount correction coefficient for a fuel injection valve.

At S1008, the fuel injection amount at the fuel injection valve is corrected on the basis of the purge air-fuel ratio obtained using expression (25). FIG. 11 depicts a relation between the purge air-fuel ratio and a fuel injection amount correction coefficient for the fuel injection valve.

The fuel injection amount is a sum of an injection amount injected by the fuel injection valve and an amount of fuel contained in the purge gas. Thus, the injection amount to be injected by the fuel injection valve is calculated on the basis of the amount of fuel assumed to be contained in the purge gas. When the purge air-fuel ratio is low (rich), the correction coefficient is calculated so that the fuel injection amount by the fuel injection valve is small. When the purge air-fuel ratio is high (lean), the correction coefficient is calculated so that the fuel injection amount by the fuel injection valve is large. If the determination at S1005 is in the negative, the purge gas does not contain the fuel evaporative emissions. Thus, the purge air-fuel ratio=∞ (the right end in FIG. 11) and the control is performed so that the fuel injection valve injects a total amount of fuel required.

The fuel evaporative emissions adsorbed by the activated carbon 57 in the charcoal canister 56 do not remain constant. The purge air-fuel ratio can thus be accurately obtained by the humidity sensors disposed in the intake pipe as in the present embodiment and the fuel injection amount at the fuel injection valve can be accurately found.

Third Embodiment

A third embodiment will be described below with reference to the accompanying drawings. The internal combustion engine in the third embodiment has a general configuration identical to what is illustrated in FIG. 1 except that the EGR system including the EGR pipe 63, the EGR cooler 64, and the EGR valve 65 is excluded.

Figure 12:
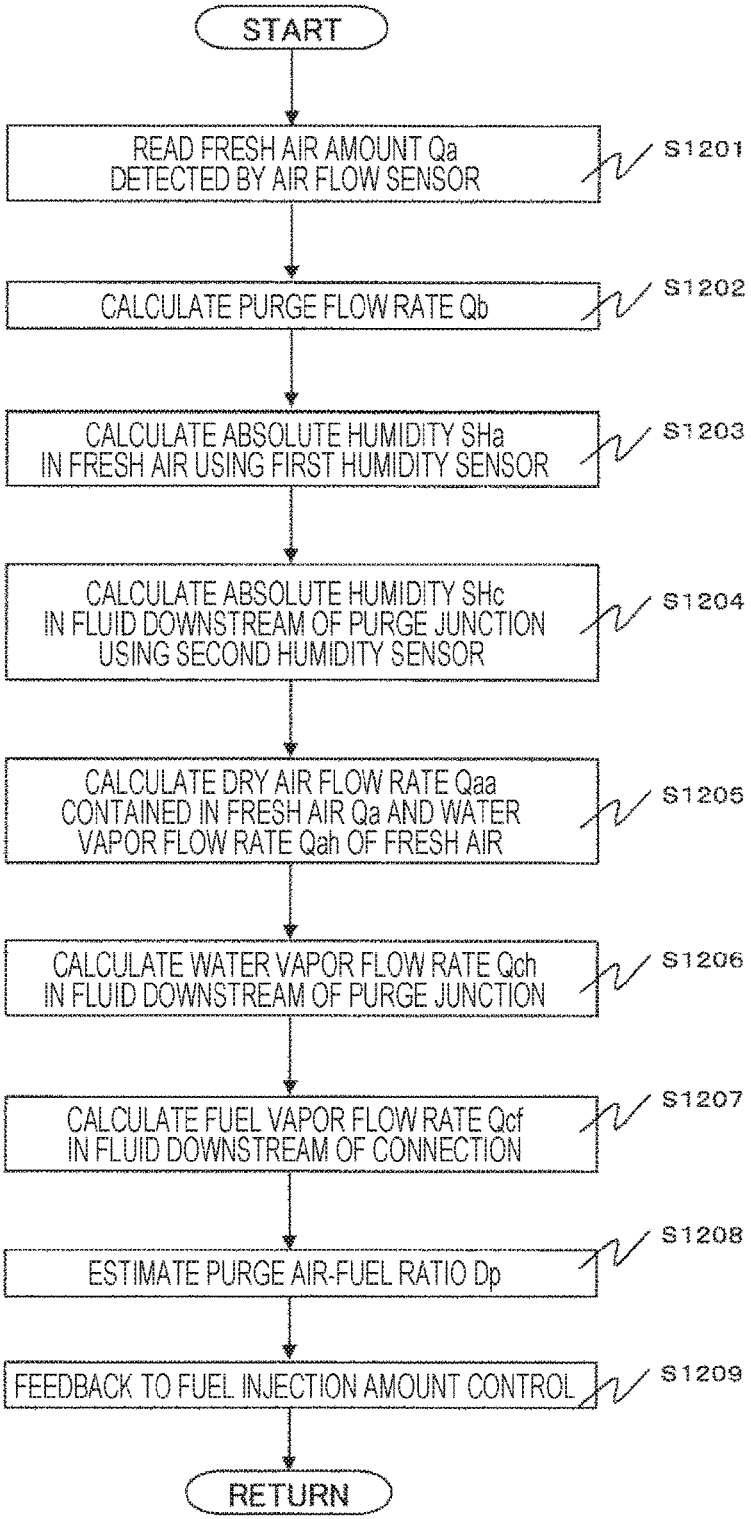
FIG. 12 is a flowchart for the purge air-fuel ratio estimation and the fuel injection amount correction using absolute humidity.

FIG. 12 is a flowchart for controlling the fuel injection amount on the basis of a purge air-fuel ratio that represents a ratio of purge gas to fresh air at a position downstream of the connection between the intake pipe 20 and the purge introduction pipe 60 and that is estimated using absolute humidity detected by the first humidity sensor 48 and the second humidity sensor 49 disposed upstream and downstream, respectively, of the connection between the intake pipe 20 and the purge introduction pipe 60.

At S1201, an air content signal Qa detected by the air flow sensor 50 is read and the subsequent step is performed. The air content signal Qa is in units of [g/s].

At S1202, a purge flow rate signal Qb is read and the subsequent step is performed. The purge flow rate signal Qb is in units of [g/s]. The purge flow rate Qb is controlled by the purge control valve 61 and can be determined by vacuum in the intake pipe.

At S1203, a signal detected by the first humidity sensor 48 is read and a water content SHa in the fluid (in this case, fresh air) is calculated. The water content Sha is in units of [g/gDA] and represents mass of water vapor to 1 g of dry air contained in air having certain humidity. In some industrial fields, the water content SHa may be referred to as weight absolute humidity or mixing ratio. A specific method for calculating SHa will be described with reference to FIG. 11.

Figure 13:
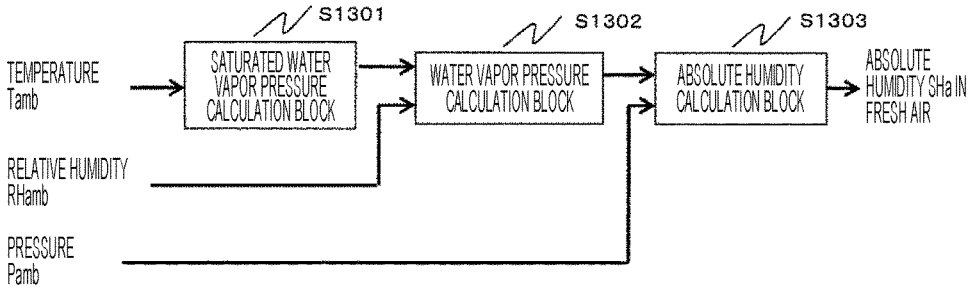
FIG. 13 is a block diagram for calculating a water content from a first humidity sensor signal.

FIG. 13 is a block diagram for calculating the water content SHa using the signal from the first humidity sensor 48.

First, the relative humidity RHamb, the pressure Pamb, and the temperature Tamb are read from the first humidity sensor 48.

Next, at saturated water vapor pressure calculation block S1301, the saturated water vapor pressure Pw at the temperature Tamb is calculated using the temperature Tamb. For the calculation of the saturated water vapor pressure Pw, a table may be prepared to define a relation between temperature and saturated water vapor pressure. Alternatively, expression (1) noted earlier may be used to calculate the saturated water vapor pressure Pw. In expression (1), Pw and Tamb are in units of [hPa] and [° C.], respectively.

At water vapor pressure calculation block S1302, the water vapor pressure Pwa is calculated using the saturated water vapor pressure Pw and the relative humidity RHamb. The water vapor pressure Pwa can be calculated using expression (2) noted earlier, where RHamb and Pwa are in units of [% RH] and [hPa], respectively.

At water content calculation block S1303, the water content SHa in the fluid (in this case, fresh air) is calculated using the water vapor pressure Pwa and the pressure Pamb, and using expression (26) below.

[Math. 26]

$$SH_a = 0.62198 \times \frac{P_{wa}}{P_{amb} - P_{wa}} \quad \text{Expression (26)}$$

At S1204, a signal detected by the second humidity sensor 49 is read and a water content SHc in a fluid (in this case, a gaseous mixture of fresh air and EGR gas). The water content SHc is in units of [g/gDA]. A specific method for calculating SHc will be described with reference to FIG. 12.

Figure 14:
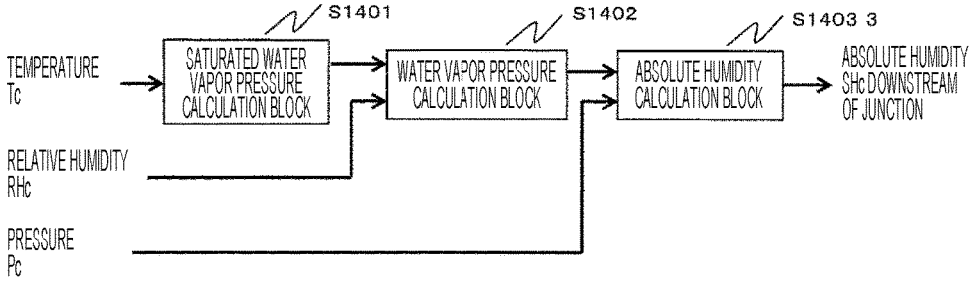
FIG. 14 is a block diagram for calculating a water content from a second humidity sensor signal.

FIG. 14 is a block diagram for calculating the water content SHc using the signal from the second humidity sensor 49. First, relative humidity RHc, pressure Pc, and temperature Tc are read from the second humidity sensor 49.

Next, at saturated water vapor pressure calculation block S1401, the saturated water vapor pressure Pw at the temperature Tc is calculated using the temperature Tc. For the calculation of the saturated water vapor pressure Pw, a table may be prepared to define a relation between temperature and saturated water vapor pressure. Alternatively, Tamb in expression (1) noted earlier may be replaced by Tc to perform the calculation. As with Tamb, Tc is in units of [° C.].

At water vapor pressure calculation block S1402, water vapor pressure Pwc is calculated using the saturated water vapor pressure Pw and relative humidity RHc. The water vapor pressure Pwc can be calculated using expression (4) noted earlier, where RHc and Pwc are in units of [% RH] and [hPa], respectively.

At water content calculation block S1403, the water content SHc in the fluid (in this case, a gaseous mixture of fresh air and EGR gas) is calculated using the water vapor pressure Pwc and the pressure Pc, and using expression (27) below.

[Math. 27]

$$SH_c = 0.62198 \times \frac{P_{wc}}{P_c - P_{wc}} \quad \text{Expression (27)}$$

At S1205, a dry air flow rate Qaa and a water vapor flow rate Qah are calculated using the air content signal Qa detected by the air flow sensor 50 and the water content SHa. Expression (28) depicts a relation between the air content Qa and the dry air flow rate Qaa, and between the air content Qa and the water vapor flow rate Qah. Specifically, air is separated into dry air and water vapor.

[Math. 28]

$$Q_a = Q_{aa} + Q_{ah} \quad \text{Expression (28)}$$

The water content SHa represents mass of water vapor with respect to 1 g of dry air contained in air having certain humidity. Thus, the water vapor flow rate Qah is given by expression (29).

[Math. 29]

$$Q_{ah} = Q_{aa} \times SH_a \quad \text{Expression (29)}$$

Substituting expression (29) for expression (28) and arranging the result with respect to Qaa give expression (30).

[Math. 30]

$$Q_{aa} = \frac{Q_a}{1 + SH_a} \quad \text{Expression (30)}$$

The dry air flow rate Qaa and the water vapor flow rate Qah are obtained using expression (29) and expression (30) and the subsequent step is performed.

At S1206, a water vapor flow rate Qch contained in the fluid (in this case, a gaseous mixture of fresh air and EGR gas) downstream of the connection between the intake pipe 20 and the purge introduction pipe 60 is calculated using the air content signal Qa detected by the air flow sensor 50, the purge flow rate Qb, and the water content SHc. Let Qc be a total gas flow rate of the fluid downstream of the connection and let [g/s] be the unit of the total gas flow rate. Then, the total gas flow rate Qc is given by expression (31). Specifically, the total gas flow rate Qc is a sum of the air content Qa that has flowed past the air flow sensor 50 and the purge gas flow rate Qb that has flowed from the purge introduction pipe 60 to the intake pipe 20.

[Math. 31]

$$Q_c = Q_a + Q_b \quad \text{Expression (31)}$$

Where, let Qca be a dry air flow rate of the fluid downstream of the connection and let [g/s] be the unit of the dry air flow rate. Then, a water vapor flow rate Qch of the fluid downstream of the connection is given by expression (32) in accordance with the approach identical to that taken in expression (29) given earlier.

[Math. 32]

$$Q_{ch} = Q_{ca} \times SH_c \quad \text{Expression (32)}$$

In the fresh air flow rate Qa and the flow rate Qc of fluid downstream of the connection, the ratio of dry air to water vapor remains constant, so that a relation of expression (33) given below holds. Thus, arranging the relation of expression (33) with respect to Qca gives expression (34).

[Math. 33]

$$Q_{aa}:SH_a = Q_{ca}:SH_c \quad \text{Expression (33)}$$

[Math. 34]

$$Q_{ca} = \frac{SH_c}{SH_a} \times Q_{aa} \quad \text{Expression (34)}$$

Substituting expression (34) for expression (32) gives expression (35) to find Qch.

[Math. 35]

$$Q_{ch} = \frac{(SH_c)^2}{SH_a} \times Q_{aa} \quad \text{Expression (35)}$$

At S1207, a fuel vapor flow rate Qcf of the fluid downstream of the connection is calculated. The fluid downstream of the connection is a fluid mixture of dry air, water vapor, and fuel vapor. Let Qc be the air flow rate downstream of the connection, Qca be the dry air flow rate, Qch be the water vapor flow rate, and Qcf be the fuel vapor flow rate. Then, expression (36) is given.

[Math. 36]

$$Q_{cf} = Q_c - (Q_{ca} + Q_{ch}) \quad \text{Expression (36)}$$

Qc is obtained using expression (31), Qca is obtained using expression (34), and Qch is obtained using expression (35). Substituting Qc, Qca, and Qch for expression (36) gives expression (37) that gives the fuel vapor flow rate Qcf.

[Math. 37]

$$Q_{cf} = (Q_a + Q_b) - (1 + SH_c) \times \frac{SH_c}{SH_a} \times Q_{aa} \quad \text{Expression (37)}$$

At S1208, a purge gas concentration Dp of the fluid downstream of the connection is estimated. The purge gas concentration is calculated from a ratio of the fuel vapor flow rate Qcf flowing from the purge introduction pipe 60 to the intake pipe 20 and the dry air flow rate Qca, given by expression (38).

[Math. 38]

$$D_p = \frac{Q_{ca}}{Q_{cf}} = \frac{\frac{SH_c}{SH_a} \times Q_{aa}}{(Q_a + Q_b) - (1 + SH_c) \times \frac{SH_c}{SH_a} \times Q_{aa}} \quad \text{Expression (38)}$$

At S1209, the result of the purge gas concentration Dp obtained using expression (38) is fed back to the fuel injection amount control. The fuel injection amount is calculated on the basis of the torque requirement of the internal combustion engine. The total fuel injection amount is, however, not be injected from the fuel injection valve 30 and the fuel vapor content in the purge gas needs to be subtracted.

A target air-fuel ratio (hereinafter referred to as a target A/F) is set on the basis of the operating condition and represents a ratio of mass of fresh air to fuel flowing in the cylinders 11. Let Ne [r/min] be a rotating speed of the internal combustion engine and Qca [g/s] be the dry air flow rate. Then, dry air mass Qall[g] flowing in each cylinder is given by expression (39).

[Math. 39]

$$Q_{all} = \frac{2 \times Q_{ca}}{Ne} \quad \text{Expression (39)}$$

Let β be the target A/F and Fall[g] be a required injection amount. Then, expression (40) represents a relation among β, Fall, and Qall. Specifically, β can be represented by a ratio of air mass to fuel mass.

[Math. 40]

$$\beta = \frac{Q_{all}}{F_{all}} \quad \text{Expression (40)}$$

Where, the required injection amount Fall is given by expression (41), where Finj is the injection amount by the fuel injection valve 30 and Fpur is the fuel vapor amount in the purge gas.

[Math. 41]

$$F_{all} = F_{inj} + F_{pur} \quad \text{Expression (41)}$$

Substituting expression (39) and expression (41) for expression (40) and arranging the result with respect to the injection amount Finj by the fuel injection valve 30 give expression (42).

[Math. 42]

$$F_{inj} = \frac{2}{Ne}\left(\frac{Q_{ca}}{\beta} - Q_{cf}\right) \quad \text{Expression (42)}$$

Expression (42) enables calculation of the fuel injection amount in which the purge concentration is incorporated and highly accurate fuel injection can be achieved.

REFERENCE SIGNS LIST

10 internal combustion engine
11 cylinder

11*a* cylinder head
11*b* cylinder block
14 connecting rod
15 piston
17 combustion chamber
19 air cleaner
20 intake pipe
21 intake valve
22 exhaust valve
23 intake camshaft
24 exhaust camshaft
25 throttle valve
27 collector
28 intake manifold
29 intake port
30 fuel injection valve
34 ignition coil
35 ignition plug
40 exhaust passage
45 temperature sensor
48 first humidity sensor
49 second humidity sensor
50 air flow sensor
51 air-fuel ratio sensor
52 oxygen sensor
53 fuel tank
54 fuel pump
55 fuel pressure regulator
56 charcoal canister
57 activated carbon
58 canister pipe
59 fresh air introduction pipe
60 purge introduction pipe
61 purge control valve
62 three-way catalyst
63 EGR pipe
64 EGR cooler
65 EGR valve
70 accelerator operation amount sensor
100 ECU

The invention claimed is:

1. A control apparatus for an internal combustion engine, the control apparatus controlling the internal combustion engine including an intake pipe and a throttle valve disposed in the intake pipe, the throttle valve controlling an air flow rate, the control apparatus comprising:

an introduction port that is disposed in the intake pipe and through which a gas other than fresh air flows in the intake pipe, wherein the control apparatus controls the internal combustion engine using detection values of humidity sensors disposed upstream and downstream, respectively, of the introduction port, a purge system disposed in the intake pipe, the purge system including: a canister that adsorbs fuel evaporative emissions to thereby allow the internal combustion engine to draw air while diluting the fuel evaporative emissions with atmosphere; and a purge flow rate estimation unit that introduces a purge gas as the gas other than fresh air, wherein the purge gas is connected to a connection with the intake pipe via a purge introduction pipe, and the internal combustion engine is controlled using the detection values of the humidity sensors disposed upstream and downstream, respectively, of the connection, and wherein a purge air-fuel ratio as a ratio of air to the fuel evaporative emissions contained in the purge gas at a position downstream of the connection is obtained using the detection values of the respective humidity sensors.

2. The control apparatus for an internal combustion engine according to claim 1, comprising:

a return pipe disposed in the intake pipe, the return pipe returning part of an exhaust gas and introducing an EGR gas as the gas other than fresh air, wherein the control apparatus controls the internal combustion engine using the detection values of the humidity sensors disposed upstream and downstream, respectively, of a connection between the intake pipe and the return pipe.

3. The control apparatus for an internal combustion engine according to claim 2, wherein an EGR rate that represents a ratio of intake air flowing through the intake pipe and the EGR gas returned through the return pipe is estimated using the detection values of the respective humidity sensors.

4. The control apparatus for an internal combustion engine according to claim 3, wherein the EGR rate in the intake pipe is estimated using volume fractions of water vapor upstream and downstream, respectively, of the connection of the intake pipe and a volume fraction of water vapor in the exhaust gas.

5. The control apparatus for an internal combustion engine according to claim 4, wherein the volume fraction of water vapor that increases through combustion in the exhaust gas is calculated on the basis of a ratio of carbon to hydrogen in fuel.

6. The control apparatus for an internal combustion engine according to claim 5, comprising:

a fuel property determination unit, wherein the ratio of carbon to hydrogen in fuel is determined on the basis of a fuel property determination result.

7. The control apparatus for an internal combustion engine according to claim 4, wherein, when the EGR rate in the intake pipe is higher than a target EGR rate, ignition timing is advanced.

8. The control apparatus for an internal combustion engine according to claim 4, wherein, when the EGR rate in the intake pipe is higher than a target EGR rate, an EGR valve opening is controlled to be brought on a closing side with respect to a current opening.

9. The control apparatus for an internal combustion engine according to claim 4, wherein, when the EGR rate in the intake pipe is lower than a target EGR rate, ignition timing is retarded.

10. The control apparatus for an internal combustion engine according to claim 4, wherein, when the EGR rate in the intake pipe is lower than a target EGR rate, an EGR valve opening is controlled to be brought on an opening side with respect to a current opening.

11. The control apparatus for an internal combustion engine according to claim 1, wherein the purge air-fuel ratio as the ratio of air to the fuel evaporative emissions contained in the purge gas at a position downstream of the connection is obtained using relative humidity upstream and downstream, respectively, of the connection.

12. The control apparatus for an internal combustion engine according to claim 1, wherein the purge air-fuel ratio as the ratio of air to the fuel evaporative emissions contained in the purge gas at a position downstream of the connection is obtained using absolute humidity upstream and downstream, respectively, of the connection.

13. The control apparatus for an internal combustion engine according to claim 11, wherein a fuel injection amount at a fuel injection valve is corrected on the basis of an estimated result of the purge air-fuel ratio.

* * * * *